US005808596A

United States Patent [19]

Kim

[11] Patent Number: 5,808,596

[45] Date of Patent: Sep. 15, 1998

[54] LIQUID CRYSTAL DISPLAY DEVICES INCLUDING AVERAGING AND DELAYING CIRCUITS

[75] Inventor: Tae-Sung Kim, Kyungki-do, Rep. of Korea

[73] Assignee: Samsung Electronics Co., Ltd., Suwon, Rep. of Korea

[21] Appl. No.: 760,581

[22] Filed: Dec. 4, 1996

[30] Foreign Application Priority Data

Dec. 5, 1995 [KR] Rep. of Korea ..... 1995-46785

[51] Int. Cl.[6] ..... G09G 3/36

[52] U.S. Cl. ..... 345/98; 345/100

[58] Field of Search ..... 345/98, 100, 99, 345/87, 88, 89, 211, 212, 213, 132, 136, 137, 138, 147; 348/790, 791, 792, 793

[56] References Cited

U.S. PATENT DOCUMENTS 5,089,812 2/1992 Fuse et al. ..... 345/147
5,365,284 11/1994 Matsumoto et al. ..... 345/100
5,512,915 4/1996 Leroux ..... 345/100
5,579,027 11/1996 Sakurai et al. ..... 345/100

*Primary Examiner*—Xiao Wu
*Attorney, Agent, or Firm*—Myers Bigel Sibley & Sajovec

[57] ABSTRACT

A liquid crystal display includes an averaging circuit which is responsive to a source of input pixel data and is connected to first alternating rows of liquid crystal display pixels, and which averages adjacent input pixel data values. A delaying circuit is responsive to the source of pixel data and is connected to second alternating rows of liquid crystal display pixels. The delaying circuit imparts a sufficient time delay to the input pixel data, to synchronize the averaged adjacent pixel data which is applied to the first alternating rows of liquid crystal display pixels, with the time delayed input pixel data which is applied to the second alternating rows of liquid crystal pixels. High resolution images for liquid crystal displays may be produced without requiring excessively high clock frequencies or excessive amounts of memory.

20 Claims, 3 Drawing Sheets

LIQUID CRYSTAL DISPLAY DEVICES INCLUDING AVERAGING AND DELAYING CIRCUITS

FIELD OF THE INVENTION

This invention relates to display devices, and more particularly to liquid crystal display devices.

BACKGROUND OF THE INVENTION

Display devices such as cathode ray tubes (CRT) and liquid crystal displays (LCD) are widely used to display images. As is well known to those having skill in the art, a measure of the quality of image data is the resolution thereof. In general, the higher the resolution, the clearer the image.

As is also well known to those having skill in the art, several standard resolutions are presently used with computer displays, including 640×480 (VGA), 800×600 (SVGA) and 1024×768 (XGA). Other higher and lower resolutions may also be used.

Due to the difference in resolutions of image data and display devices, it is often desirable to change the resolution of image data. A conventional technique for converting image data resolution stores image data in a video memory and uses software to change the resolution of the stored data. The changed resolution data is then sent to the display.

For example, if an image is scanned with VGA resolution, but is displayed in SVGA mode, the resolution of the image on the display may be inferior to that of the original picture. Moreover, if the resolution of the image is not adjusted properly, only part of the image may be displayed on the display. Accordingly, conventionally, the image data is stored in video memory, converted to the resolution of the display and then the image is displayed.

One technique for changing the resolution of an image copies the image data of a pixel to an adjacent pixel. In another technique, the image data of adjacent pixels are averaged and the average value is used between the adjacent pixels.

Unfortunately, the LCD often presents unique resolution problems. In particular, the LCD generally has a fixed geometrical structure. Accordingly, the resolution of the image data should generally correspond to the resolution of the LCD. If the image resolution is higher than the LCD resolution, then only part of the image may be displayed. Conversely, if the image resolution is lower than the LCD resolution, the image may be displayed on only a part of the LCD.

Moreover, the size of LCDs has continued to increase. LCDs also are presently envisioned for large wall-mounted televisions or multimedia monitors. However, if a low resolution image is displayed on a large LCD, the display may look poor because the pixel size of the image may be large. Accordingly, it is desirable to increase the resolution of LCDs to obtain a high quality image.

Unfortunately, an increase in resolution of an LCD may be difficult. First, an increase in resolution may also increase the clock frequency of the LCD. Unfortunately, it may be difficult to increase the clock frequency beyond a maximum operational frequency of the LCD. Moreover, electromagnetic interference may be generated as the clock frequency increases. An increase in resolution also may require adding large amounts of memory to the LCD and may also increase the complexity of the other components of the LCD.

SUMMARY OF THE INVENTION

It is therefore an object of the present invention to provide liquid crystal displays which are capable of high resolution.

It is another object of the present invention to provide high resolution liquid crystal displays which do not require excessive increases in clock frequency in order to increase resolution.

It is yet another object of the present invention to provide high resolution liquid crystal displays which do not require large increases in memory or other supporting circuitry to achieve high resolution.

These and other objects are provided, according to the present invention, by liquid crystal displays (LCD) which include an averaging circuit which is responsive to a source of input pixel data, which is connected to first alternating rows of LCD pixels, and which averages adjacent input pixel data values. The LCD also includes a delaying circuit which is responsive to the source of pixel data and which is connected to second alternating rows of LCD pixels. The delaying circuit imparts a sufficient time delay to the input pixel data to synchronize the averaged adjacent pixel data which is applied to the first alternating rows of LCD pixels, with the time delayed input pixel data which is applied to the second alternating rows of LCD pixels. Accordingly, by using the averaging circuit and delaying circuit, the resolution of the LCD can be improved without requiring high frequency clocks or large amounts of memory or other additional supporting circuitry.

In particular, LCDs according to the present invention include an array of LCD pixels arranged in a plurality of rows. It will be understood that, as used herein, "rows" refers to LCD pixels which extend along either a vertical direction or a horizontal direction in the LCD. A first data driver and a second data driver drive alternating rows of the LCD pixels. For example, one of the first and second data drivers may drive odd rows of the LCD pixels, and the other of the first and second display drivers drive even rows of the LCD pixels.

LCD devices according to the invention also include an averaging circuit which is responsive to a source of input pixel data and which is connected to the second data driver. The averaging circuit averages adjacent input pixel data values. A delaying circuit is also responsive to the source of pixel data, and is connected to the first data driver. The delaying circuit imparts a sufficient time delay to the input pixel data to synchronize the averaged adjacent pixel data which is applied to the second data driver with the time delayed input pixel data which is applied to the first data driver. In particular, when the averaging circuit imparts a predetermined time delay to the average adjacent pixel data relative to the input pixel data, the delaying circuit also preferably imparts the predetermined time delay to the input pixel data.

The averaging circuit preferably comprises a latch which is connected to the source of input pixel data. An adder is connected to the source of input pixel data and to the output of the latch. An averager is connected to the output of the adder to produce the averaged adjacent pixel data. Preferably, the latch and the adder are clocked by a common clock signal and the divider comprises a divide-by-two circuit.

Also preferably, according to the present invention, the delaying circuit comprises a plurality of cascaded flip-flops, wherein the output of an immediately preceding flip-flop is connected to the input of an immediately succeeding flip-flop. The first flip-flop is connected to the input pixel data and the last flip-flop is connected to the first data driver.

Accordingly, the resolution of the LCD can be changed without requiring large amounts of memory or other supporting circuitry, or excessively high clock frequencies.

DETAILED DESCRIPTION OF PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Figure 1:
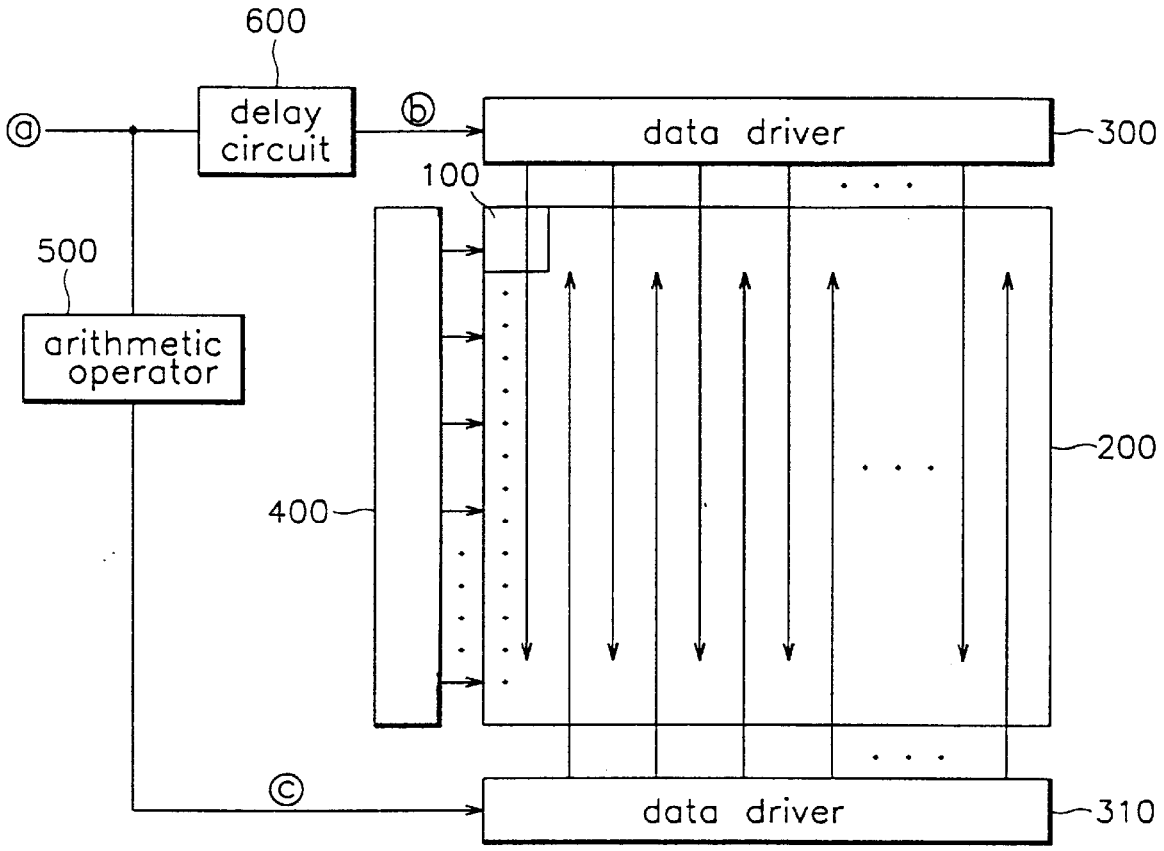
FIG. 1 is a schematic block diagram of an LCD according to the present invention.

Referring now to FIG. 1, a block diagram of an LCD according to the present invention is illustrated. The LCD includes a plurality of pixels 100 which are arranged at the intersections of gate lines and data lines. As shown in FIG. 1, the gate lines extend horizontally and the data lines extend vertically. However, other arrangements may be used. A thin film transistor (TFT) panel 200 transmits image data to the plurality of pixels 100. A first and second data driver 300 and 310 respectively apply image data from the upper and lower portions of the display through the data lines. However, other locations of first and second data drivers may be used. A gate driver 400 transmits a gate driving signal for the TFTs in the TFT panel 200 via the gate lines. The above-described components of an LCD are well known to those having skill in the art and need not be described further herein.

Continuing with the description of FIG. 1, the LCD includes an arithmetic operator 500 in the form of an averaging circuit which is responsive to the source of input pixel data (a) and is connected to the second data driver 310. The arithmetic operator 500 averages adjacent input pixel data values and supplies the average adjacent input pixel data values (c) to the second data driver 310.

Figure 2:
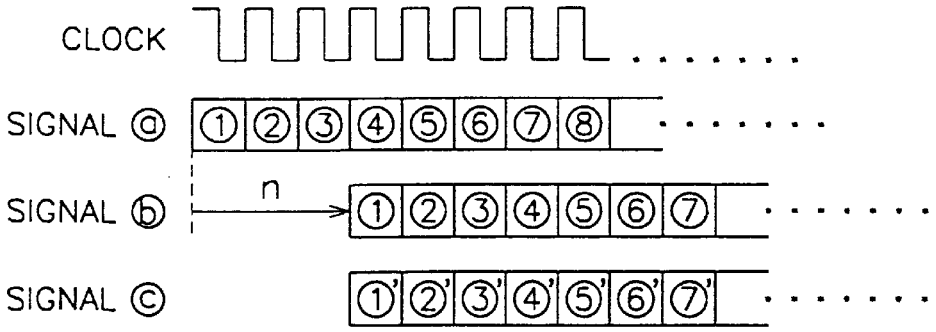
FIG. 2 is a timing chart for various signals of FIG. 1.

The LCD also includes a delay circuit 600 which controls the time delay between the first and second data drivers 300 and 310 respectively. In particular, the delay circuit is also responsive to the source of pixel data (a) and is connected to the first data driver 300. The delaying circuit 100 imparts a sufficient time delay to the input pixel data (a) to synchronize the average adjacent pixel data (c) which is applied to the second data driver 310, with the time delayed input pixel data (b) which is applied to the first data driver 300. Thus, as shown in FIG. 2, signals (b) and (c) are synchronized.

Figure 4:
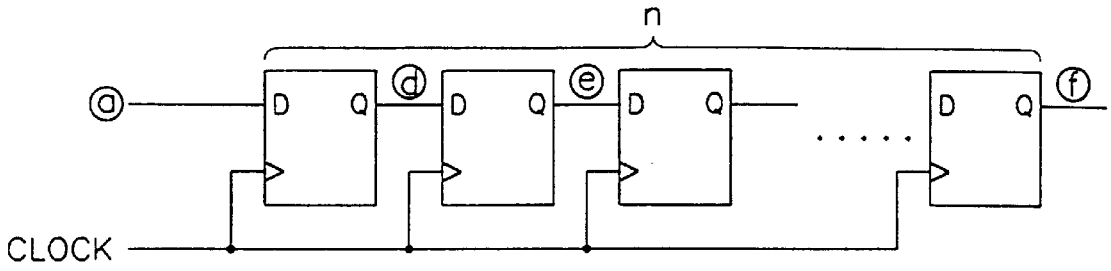
FIG. 4 is a schematic block diagram of a delay circuit according to the present invention.
Figure 5:
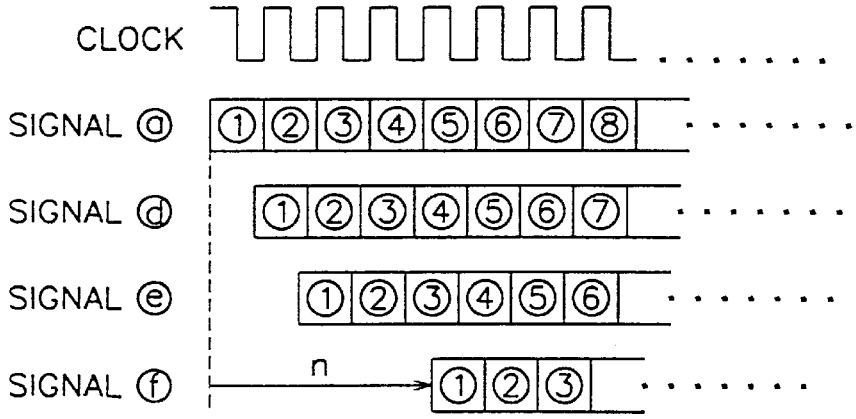
FIG. 5 is a timing diagram for the delay circuit of FIG. 4.

As shown in FIG. 4, the delay circuit 600 preferably includes a plurality n of D-type flip-flops in a cascaded arrangement, and including a first flip-flop and a last flip-flop. The first flip-flop receives pixel data (a) and the last flip-flop produces the time-delayed input pixel data labelled (f) in FIG. 4 and labelled (b) in FIG. 1, and which is applied to the first data driver 300. Intermediate delayed signals (d) and (e) are also shown.

Figure 6:
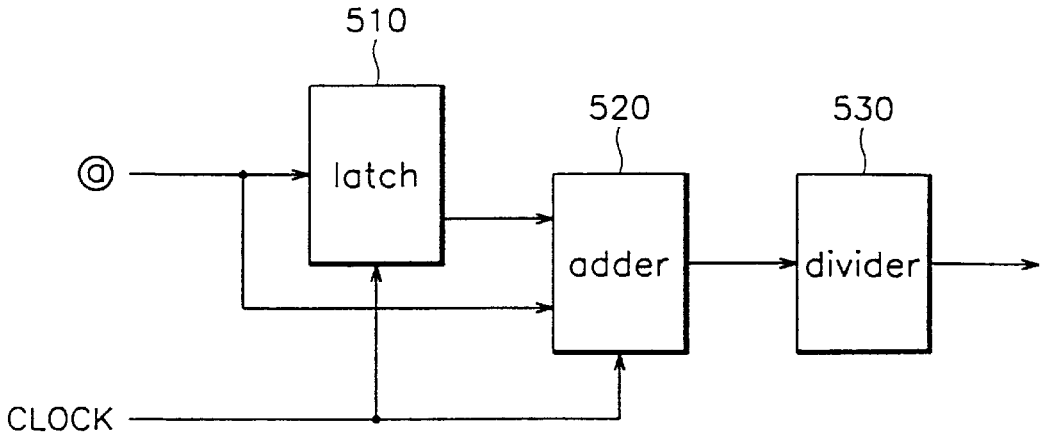
FIG. 6 is a schematic block diagram of an averaging circuit according to the present invention.

FIG. 6 is a block diagram representation of an averaging circuit 500 of FIG. 1. As shown in FIG. 6, the averaging circuit includes a latch 510 which is connected to the source of input pixel data (a). An adder 520 is connected to the source of the input pixel data (a) and to the output of the latch 510. An averager, in the form of divider (divide-by-two circuit) 530, is connected to the output of the adder 520 to produce the average adjacent pixel data (c). As also shown in FIG. 6, the latch 510 and the adder 520 are clocked by a common clock signal.

Figure 3A:
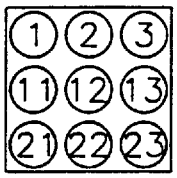
FIG. 3A (Prior Art)
FIGS. 3A–3C illustrate prior art techniques which have been used to improve the resolution of an LCD.
Figure 3B:
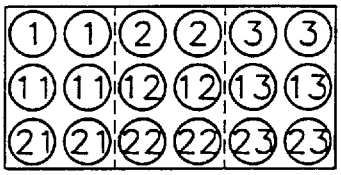
FIG. 3B (Prior Art)
Figure 3C:
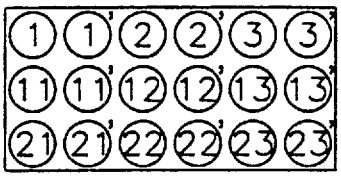
FIG. 3C (Prior Art)

Operation of an LCD according to the present invention will now be described. FIGS. 3A–3C illustrate conventional techniques which may be used to improve the resolution of an image which is applied to an LCD. In one technique, the image data of FIG. 3A is replicated by copying the image data to adjacent pixels to produce the image data of FIG. 3B. Another technique averages the image data of adjacent pixels of FIG. 3A and displays the average data between adjacent pixels, as shown in FIG. 3C. In FIG. 3C, a prime notation (')is used to indicate average pixel data.

The technique of FIG. 3C may produce a higher resolution image than the technique of FIG. 3B. The image data is generally preprocessed and stored in a large video memory and then displayed on the LCD. Thus, a low resolution image can be displayed across the entire area of a high resolution LCD.

In LCDs according to the present invention, averages of adjacent pixels are determined by an averaging circuit and are provided to the LCD without requiring that the average be stored in a large video memory. In particular, referring to FIGS. 1 and 2, input data (a) is delayed by n clock cycles using delay circuit 600. The delayed image data is provided to first data driver 300. The delay circuit 600 is used to match the delay time between the first and second data drivers 300, 310.

The arithmetic operator (averaging circuit) 500 calculates the average of the adjacent input pixel data values and outputs the averaged output to the second data driver 310. Since the averaging circuit imparts a predetermined time delay to the average adjacent pixel data relative to the input pixel data, the delay circuit 600 imparts the same predetermined time delay to the input pixel data which is applied to data driver 300. Accordingly, as shown in FIG. 2, the averaged adjacent input pixel data values which are applied to the second data driver 310 and the delayed input pixel data which is applied to the first data driver 300, are synchronized. For example, as shown in FIG. 2, an equal delay n is provided to signal (b) and signal (c) relative to signal (a).

It will be understood that the data which is produced by the second data driver 310 may be input between the data produced by the first data driver 300 because the data lines of the first and second data drivers 300 and 310 are interdigitated on the LCD. Accordingly, the clock frequency of the data drivers 300, 310 need not be doubled. High speed processing may thereby be provided without generating excessive electromagnetic interference. Moreover, a large memory for containing input data values and averaged adjacent input pixel data values need not be provided. Accordingly, a high resolution image can be generated for an LCD without requiring an increase in clock frequency and without requiring large amounts of memory.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed:

1. A liquid crystal display comprising:

an array of liquid crystal display pixels, arranged in a plurality of rows;

a first data driver and a second data driver which drive alternating rows of the liquid crystal display pixels;

an averaging circuit which is responsive to a source of input pixel data and is connected to the second data driver, and which averages adjacent input pixel data values; and a delaying circuit which is responsive to the source of pixel data and is connected to the first data driver, and which imparts a sufficient time delay to the input pixel data to synchronize the averaged adjacent pixel data which is applied to the second data driver with the time delayed input pixel data which is applied to the first data driver.

2. A liquid crystal display according to claim 1 wherein the averaging circuit comprises:

a latch which is connected to the source of input pixel data;

an adder which is connected to the source of input pixel data and to the output of the latch; and an averager which is connected to the output of the adder, to produce the averaged adjacent pixel data.

3. A liquid crystal display according to claim 2 wherein the latch and the adder are clocked by a common clock signal.

4. A liquid crystal display according to claim 2 wherein the averager comprises a divide-by-two circuit.

5. A liquid crystal display according to claim 2 wherein the delaying circuit comprises a plurality of cascaded flip-flops, including a first flip-flop and a last flip-flop, wherein the first flip-flop is connected to the input pixel data and the last flip-flop is connected to the first data driver.

6. A liquid crystal display according to claim 1 wherein one of the first and second data drivers drive odd rows of the liquid crystal display pixels, and the other of the first and second display drivers drive even rows of the liquid crystal display pixels.

7. A liquid crystal display according to claim 1 wherein the plurality of rows extend along a vertical direction or a horizontal direction of the liquid crystal display device.

8. A liquid crystal display according to claim 1 wherein the averaging circuit imparts a predetermined time delay to the averaged adjacent pixel data relative to the input pixel data, and wherein the delaying circuit also imparts the predetermined time delay to the input pixel data.

9. A liquid crystal display comprising:

an array of liquid crystal display pixels, arranged in a plurality of rows;

an averaging circuit which is responsive to a source of input pixel data and is connected to first alternating rows of liquid crystal display pixels, and which averages adjacent input pixel data values; and a delaying circuit which is responsive to the source of pixel data and is connected to second alternating rows of liquid crystal display pixels, and which imparts a sufficient time delay to the input pixel data to synchronize the averaged adjacent pixel data which is applied to the first alternating rows of liquid crystal pixels, with the time delayed input pixel data which is applied to the second alternating rows of liquid crystal display pixels.

10. A liquid crystal display according to claim 9 wherein the averaging circuit comprises:

a latch which is connected to the source of input pixel data;

an adder which is connected to the source of input pixel data and to the output of the latch; and an averager which is connected to the output of the adder, to produce the averaged adjacent pixel data.

11. A liquid crystal display according to claim 10 wherein the latch and the adder are clocked by a common clock signal.

12. A liquid crystal display according to claim 10 wherein the averager comprises a divide-by-two circuit.

13. A liquid crystal display according to claim 10 wherein the delaying circuit comprises a plurality of cascaded flip-flops, including a first flip-flop and a last flip-flop, wherein the first flip-flop is connected to the input pixel data and the last flip-flop is connected to the second alternating rows of liquid crystal pixels.

14. A liquid crystal display according to claim 9 wherein one of the first and second rows of liquid crystal pixels are odd rows of liquid crystal display pixels, and the other of the first and second rows of liquid crystal pixels are even rows of liquid crystal display pixels.

15. A liquid crystal display according to claim 9 wherein the plurality of rows extend along a vertical direction or a horizontal direction of the liquid crystal display device.

16. A liquid crystal display according to claim 9 wherein the averaging circuit imparts a predetermined time delay to the averaged adjacent pixel data relative to the input pixel data, and wherein the delaying circuit also imparts the predetermined time delay to the input pixel data.

17. A resolution enhancing circuit for a liquid crystal display which includes an array of liquid crystal display pixels arranged in a plurality of rows, the resolution enhancing circuit comprising:

an averaging circuit which is responsive to a source of input pixel data and is connected to first alternating rows of liquid crystal display pixels, and which averages adjacent input pixel data values; and a delaying circuit which is responsive to the source of pixel data and is connected to second alternating rows of liquid crystal display pixels, and which imparts a sufficient time delay to the input pixel data to synchronize the averaged adjacent pixel data which is applied to the first alternating rows of liquid crystal pixels, with the time delayed input pixel data which is applied to the second alternating rows of liquid crystal pixels.

18. A circuit according to claim 17 wherein the averaging circuit comprises:

a latch which is connected to the source of input pixel data;

an adder which is connected to the source of input pixel data and to the output of the latch; and an averager which is connected to the output of the adder, to produce the averaged adjacent pixel data.

19. A circuit according to claim 18 wherein the averager comprises a divide-by-two circuit.

20. A circuit according to claim 17 wherein the delaying circuit comprises a plurality of cascaded flip-flops, including a first flip-flop and a last flip-flop, wherein the first flip-flop is connected to the input pixel data and the last flip-flop is connected to the second alternating rows of liquid crystal pixels.

* * * * *